US009634429B2

(12) United States Patent
Chen et al.

(10) Patent No.: US 9,634,429 B2
(45) Date of Patent: Apr. 25, 2017

(54) CONNECTOR FOR A POWER INPUT

(71) Applicant: Fuzhou Six Sights Electro-Mech Co. Ltd., Fuzhou (CN)

(72) Inventors: Liang Light Chen, Los Gatos, CA (US); Jie Mo, Fuzhou (CN); Lirong Jiang, Fuzhou (CN)

(73) Assignee: Fuzhou Six Sights Electro-Mech Co. Ltd., Fuzhou (CN)

( * ) Notice: Subject to any disclaimer, the term of this patent is extended or adjusted under 35 U.S.C. 154(b) by 0 days.

(21) Appl. No.: 15/009,512

(22) Filed: Jan. 28, 2016

(65) Prior Publication Data

US 2016/0240967 A1 Aug. 18, 2016

(30) Foreign Application Priority Data

Feb. 17, 2015 (CN) ..... 2015 1 0084326

(51) Int. Cl.

| | |
|---|---|
| ***H01R 13/627*** | (2006.01) |
| ***H01R 24/20*** | (2011.01) |
| *H01R 13/512* | (2006.01) |
| *H01R 13/53* | (2006.01) |
| *H01R 13/64* | (2006.01) |
| *H01R 107/00* | (2006.01) |

(52) U.S. Cl.

CPC ..... *H01R 13/6272* (2013.01); *H01R 24/20* (2013.01); *H01R 13/512* (2013.01); *H01R 13/53* (2013.01); *H01R 13/64* (2013.01); *H01R 2107/00* (2013.01)

(58) Field of Classification Search

CPC ..... H01R 13/6272; H01R 13/6275; H01R 13/6217

USPC ..... 439/369, 358, 695, 465

See application file for complete search history.

(56) References Cited

U.S. PATENT DOCUMENTS

| | | | | |
|---|---|---|---|---|
| 6,478,609 | B1 * | 11/2002 | Davis | H01R 13/5812 439/465 |
| 7,867,015 | B1 * | 1/2011 | Parker | H02G 3/22 439/455 |
| 7,967,629 | B1 * | 6/2011 | Liu | H01R 24/20 439/354 |
| 9,225,110 | B2 * | 12/2015 | Huang | H01R 13/6272 |
| 2006/0246780 | A1 * | 11/2006 | Bert | H01R 4/2441 439/607.43 |
| 2008/0176436 | A1 * | 7/2008 | Morello | H01R 13/6272 439/289 |
| 2009/0185777 | A1 * | 7/2009 | Ziemke | G02B 6/3893 385/56 |

(Continued)

*Primary Examiner* — Tulsidas C Patel
*Assistant Examiner* — Marcus Harcum
(74) *Attorney, Agent, or Firm* — Douglas L. Weller

(57) ABSTRACT

A connector includes a socket configured to be secured within a socket opening of a power input. A socket head has a plurality of plug insert receptacles. Each plug insert receptacle receives a conductive insert. The conductive insert connects with a cable that extends from the plug insert receptacle through and out of the socket. A plug contains a base. A head of the base has a plurality of plug insert units. Each plug insert unit receives a conductive insert that connects with a cable that extends out the base of the plug. A handle covers the base. The handle and the base are fixed and connected by a positioning device that includes an inverted tooth structure. The socket and plug when connected are secured in place by an elastic hasp.

15 Claims, 4 Drawing Sheets

(56) References Cited

U.S. PATENT DOCUMENTS

| | | | | |
|---|---|---|---|---|
| 2011/0059642 | A1* | 3/2011 | Slippy | H01R 13/5808<br>439/353 |
| 2011/0076889 | A1* | 3/2011 | Rossman | H01R 13/6456<br>439/660 |
| 2014/0273585 | A1* | 9/2014 | Dang | H01R 13/6275<br>439/345 |
| 2015/0180172 | A1* | 6/2015 | Hiscoke | H01R 13/6275<br>439/153 |

* cited by examiner

CONNECTOR FOR A POWER INPUT

BACKGROUND

A power distribution unit (PDU) is often used to provide power distribution for electrical equipment within a cabinet. Configuration of PDUs vary depending upon specifications, intended functions, installation methods and different combinations of insert position. This allows PDUs to provide suitable solutions for power distribution of cabinets with different power environments. The use of a PDU with a cabinet can make power distribution within a cabinet more tidy, reliable, safe, professional and beautiful. This facilitates a convenient and reliable power supply within a cabinet. Typically when the input current exceeds 30 Amps, a PDU is directly connected to a device by a cable.

In the figures, reference numbers refer to the following:

1—socket;
111—elastic tab fasteners;
12—plug receptacle;
121—tab groove;
122—small tab groove;
13—tab for limiting;
14—conduits;
2—plug;
21—base;
211—plug insert;
2111—plug insert;
2112—small ridge;
212—tab B;
22—handle;
221—upper casing;
2211—tab C;
2212—tab groove C;
2213—tab groove B;
2214—tab D;
2215—threaded hole;
2216—through hole;
2217—annular concave-convex garnish gripping region;
222—lower casing;
23—inverted tooth structure;
231—upper inverted tooth;
2311—tab groove D;
232—lower inverted tooth;
24—hasp;
241—locking slot;
242—catching structure;

243—push button;
25—U-shaped groove;
3—cables;
4—conductive inserts.

DESCRIPTION OF THE EMBODIMENT

Figure 1:
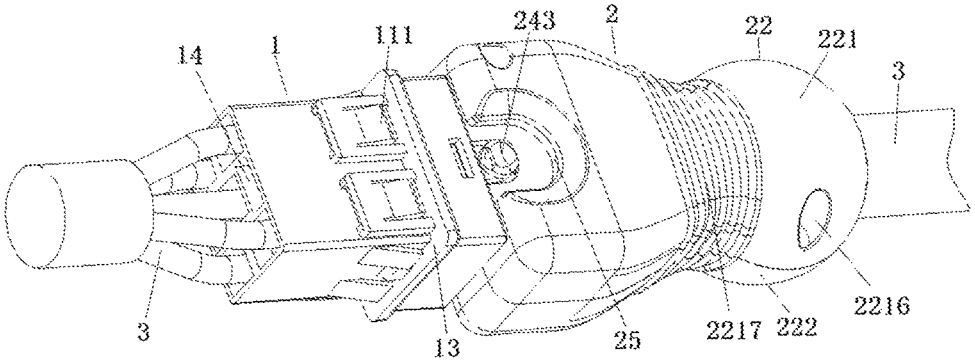
FIG. 1 shows a connector for a power input such as a power distribution unit (PDU) in accordance with an implementation.

FIG. 1 shows a high current input connector for use in a power input, such as a power distribution unit (PDU), where input current exceeds 30 Amps. The connector's features include relatively small size and simple structure allowing for easy installation and high efficiency. The connector is typically used for a PDU with high current input.

As disclosed herein a connector is used for a PDU with high current input (i.e., over 30 amps). The connector includes a socket configured to be secured within a socket opening of a PDU. A socket head has a plurality of plug insert receptacles. Each plug insert receptacle receives a conductive insert. The conductive insert connects with a cable that extends from the plug insert receptacle through and out of the socket.

A plug contains a base. A head of the base has a plurality of plug insert units. Each plug insert unit receives a conductive insert that connects with a cable that extends out the base of the plug. A handle covers the base. The handle and the base are fixed and connected by a positioning device that includes an inverted tooth structure. The socket and plug when connected are secured in place by an elastic hasp.

For example, the socket head includes a lip that limits insertion of the plug into the socket. Elastic tab fasteners are arranged to secure the socket within the socket opening of the PDU. The tail of the socket and the base are each provided with conduits for guiding cables.

For example, at least one plug insert receptacle includes a tab groove. At least one plug insert unit includes a tab. The tab fits within the tab groove.

For example, the handle includes an upper casing that includes a U-shaped section. A first tab is located at one side of the upper casing. Another side of the upper casing includes a first tab groove. A tail of the upper casing has a cylindrical shape. The upper casing is provided with a threaded hole along one diagonal and a through hole along another diagonal. A lower casing has identical structure to the upper casing.

For example, a second tab extends along a radial direction on one side of the upper casing. A second tab groove extends along the radial direction on another side of the upper casing.

For example, the inverted tooth structure includes an upper inverted tooth structure. The upper inverted tooth structure is a half ring. An outside diameter of the upper inverted tooth structure is consistent with the inside diameter of the tail of the upper casing. A lower inverted tooth structure is identical in structure to the upper inverted tooth structure.

For example, the handle has a U-shaped opening allowing user access to the elastic hasp.

For example, the hasp includes a catching groove located on the head of the socket. A catching structure on the head of the base of the plug is located within the U-shaped groove of the handle. One end of the catching structure is fixed to the base. A middle of the catching structure is provided with a wedge-shaped tap that matches with the catching groove. Another end of the catching structure includes a push button.

For example, an annular concave-convex garnish gripping region is located at a periphery of the handle.

The connector meets the needs of a PDU with a narrow width for a socket when the current is greater than 30 A and the input voltage is greater than 125V. This is a smaller shape relative to a conventional socket, such as NEMA L6-30R (single phase 3Pin), L21-30R (three phase 5Pin), IEC60309 series and other high-current input sockets.

The high-current connector allows that input cables need not be completed at the time of production of the PDU. The terminal may be used or produced in accordance with the actual demand to make input cables and plugs, irrespective of the input cables in the production of the PDU. The cables are connected when installing the PDU.

The design of the high-current plug fixing the hasp makes the input plug and socket reliably fixed. The relatively small form factor allows the connector to be used in small spaces. The design of the handle of the plug with the inverted tooth structure makes it so that a pulling force on the cables acts on the inverted teeth only, not the conductive inserts of the plug.

The high-current socket designed can be used for 3-pin, 4-pin and 5-pin (that is single-phase, three-phase star connection wiring, a three-phase delta method) plugs.

Figure 2:
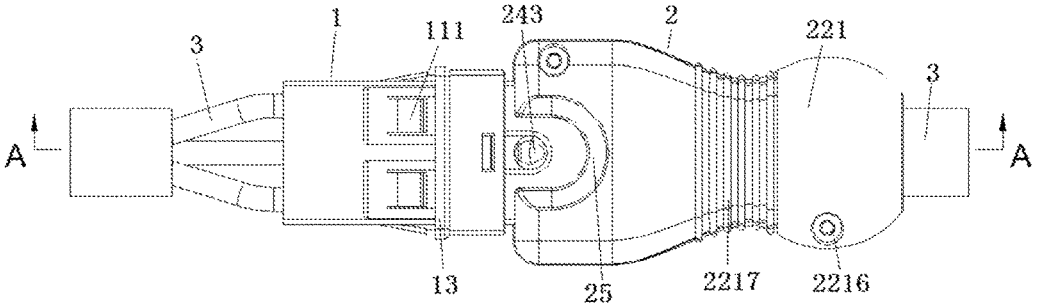
FIG. 2 is a top plan view of the connector shown in FIG. 1 in accordance with an implementation.
Figure 3:
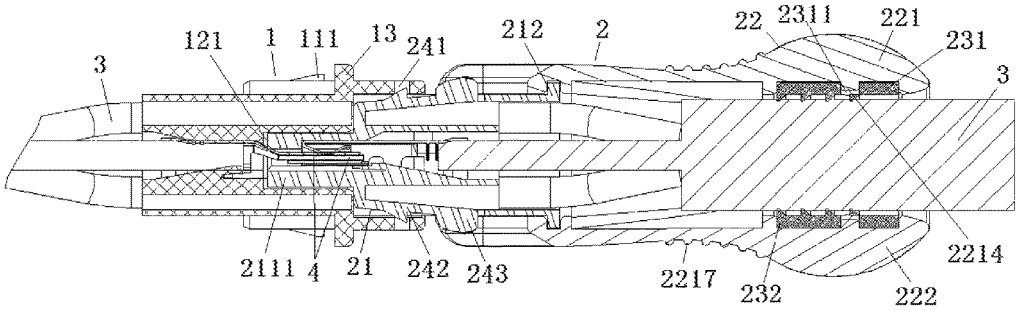
FIG. 3 is an A-A cross-sectional view of the connector shown in FIG. 2 in accordance with an implementation.

FIG. 1, FIG. 2, FIG. 3, FIG. 4, FIG. 5, FIG. 6 and FIG. 7 show different aspects of a high-currency connector. FIG. 1, FIG. 2 and FIG. 3 show various views of the high-currency connector in a connected orientation.

The connector includes a socket 1 and a plug 2. Socket 1 is secured within a socket opening of a PDU by elastic tab fastener 111 located on a periphery of socket 1. A head of socket 1 is provided with a plurality of plug-in receptacles 12, shown in FIG. 5. Conductive inserts 4, shown in FIG. 3, when located inside plug-in receptacles 12 connect with cables located in the socket opening of the PDU and through a tail of socket 1.

Plug 2 contain a base 21. A head of base 21 is provided with a plurality of plug insert units 211, shown in FIG. 5. Conductive inserts 4 of plug insert units 211 connect with cables 3 located in the tail of base 21. The outside of base 21 is covered with a handle 22. Handle 22 and base 21 are fixed and connected by a positioning device. Handle 22 and cables 3 are in contact with an inverted tooth structure 23, shown in FIG. 7. Socket 1 and plug 2 are connected and held fixed by an elastic hasp 24, shown in FIG. 7.

For example, the head of socket 1 includes a lip 13 that limits insertion of socket 1 into plug 2. Elastic tab fasteners 111 are fixed to a periphery of socket 1, as shown in FIGS. 1, 2 and 3. Each of elastic tab fasteners 111 opens towards the head of socket 1, the tail of socket 1 and base 21. A plurality of conduits guide cables 3 into socket 1.

In this example, the plug-in receptacles 12 are each comprised of some plug insert receptacles 121 located in the head of the socket 1. The plug insert units 211 are each comprised of plug insert units 2111 located in the head of the base 21. Plug insert units 2111 are sized and positioned to allow plug insert units 2111 to embed into plug insert receptacles 121.

Figure 6:
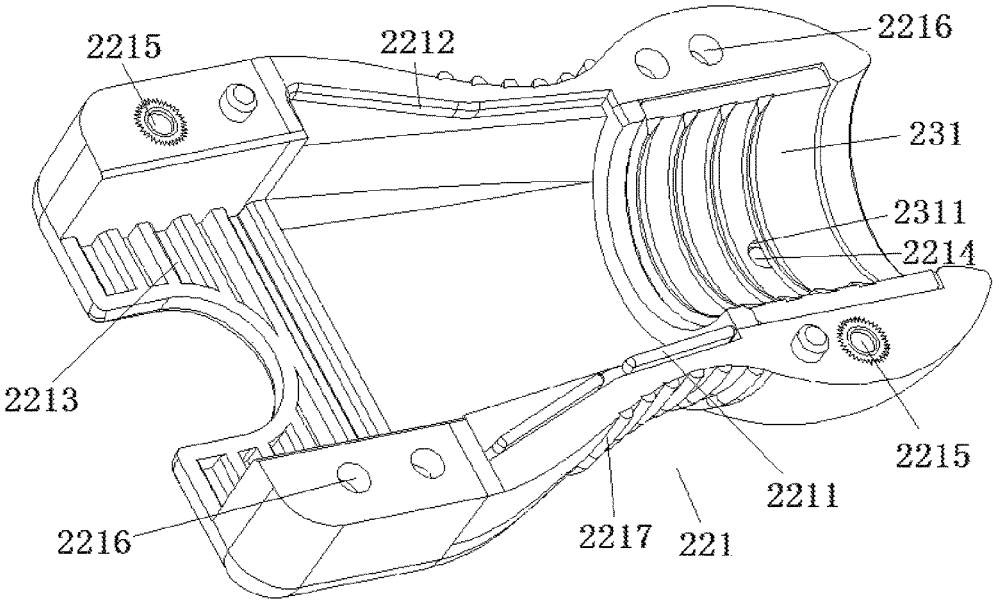
FIG. 6 is a schematic structural view of upper casing for a connector for a PDU in accordance with an implementation.
Figure 7:
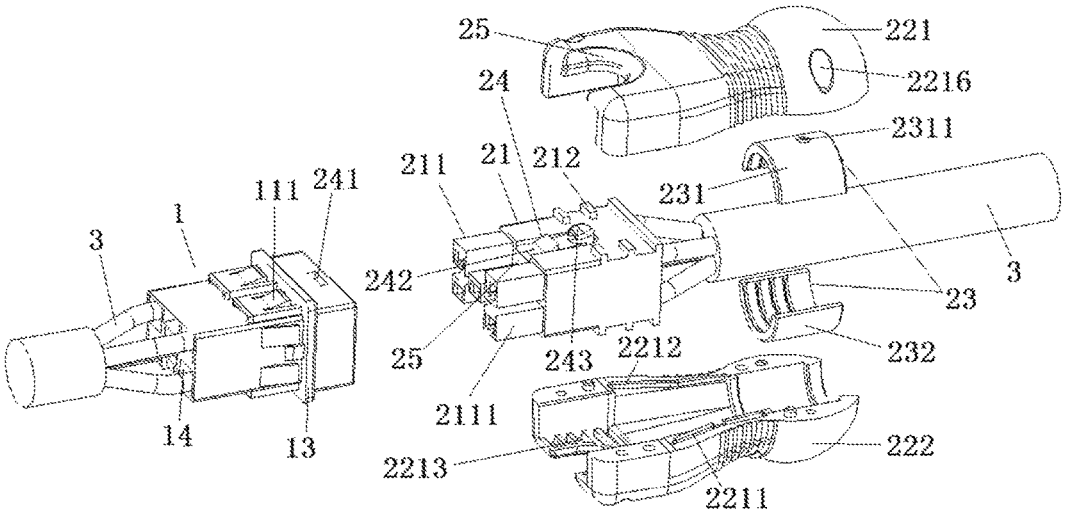
FIG. 7 is a disassembled view of a connector for a PDU in accordance with an implementation.

In this example, the handle 22 is comprised of an upper casing 221 and a lower casing 222 which have identical structure, as shown in FIG. 7. Upper casing 221 is U-shaped. One side in the middle of the upper casing 221 is provided with a tab 2211. Another side is also provided with a tab groove. The head of upper casing 221 is provided with tab grooves 2213. The tail of the upper casing 221 has a cylindrical shape. A tab 2214 is located along the radial direction, as shown in FIG. 6. Upper casing 221 is provided with a threaded hole 2215 along one of the diagonal, as shown in FIG. 6. A through hole 2216 is located on the opposite diagonal.

In this example, the positioning device includes tabs 212 fixed in the middle of base 21. The tabs 212 embed in tab grooves 2213 which are in the head of upper casing 221 and lower casing 222, as shown in FIGS. 6 and 7.

For example, inverted tooth structure 23 is comprised of an upper inverted tooth structure 231 and a lower inverted 232 tooth structure which have identical structure, as shown in FIG. 7. Upper inverted tooth 231 is a half ring. The outside diameter of upper inverted tooth 231 is consistent with the inside diameter of the tail of upper casing 232.

For example, the middle of base 21 and the head of handle 22 have opened a U-shaped groove 25 for installing the hasp 24, as shown in FIG. 7.

For example, hasp 24 is comprised of a locking slot 241 and a catching structure 242, as shown in FIG. 7. Locking slot 241 is located at a periphery of the head of the socket 1. Catching structure 242 is set up on the head of the base of the plug 2 and falls within U-shaped groove 25 of handle 22. One end of the catching structure 242 is fixed to base 21. The middle of base 21 is provided with a wedge-shaped structure for matching with locking slot 241. The other end of catching structure 242 is a push button 243, shown in FIG. 7. Pressing push button 243 presses down catching structure 242 allowing for disengagement.

Figure 4:
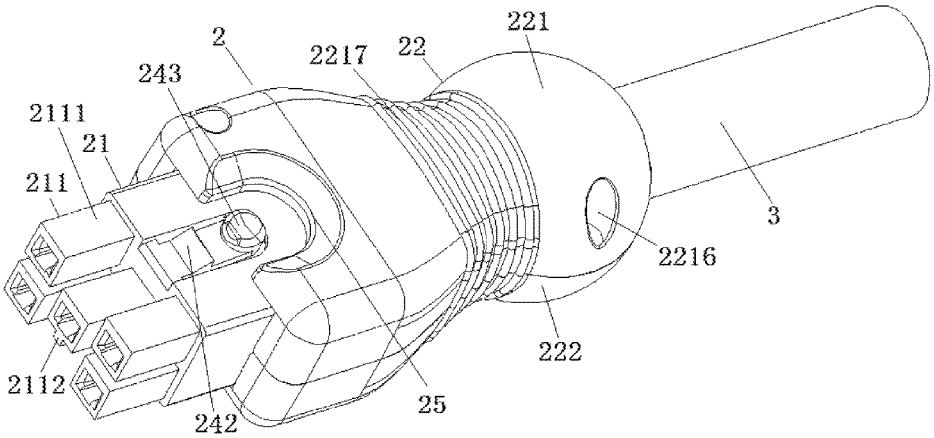
FIG. 4 is a schematic structural view of a plug for a connector for a PDU in accordance with an implementation.
Figure 5:
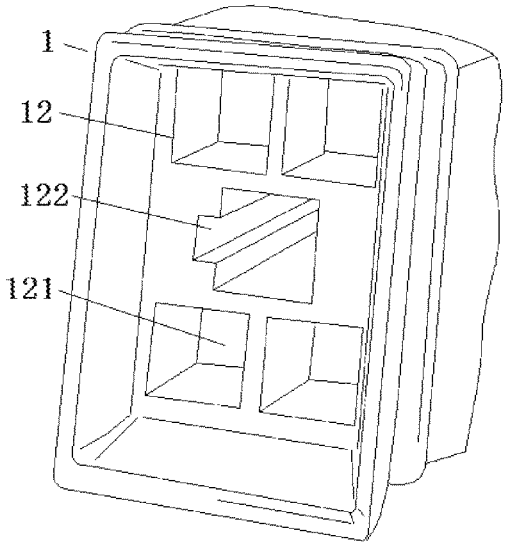
FIG. 5 is a schematic structural view of a head of a socket for a connector for a PDU in accordance with an implementation.

For example, along an outspread direction of plug insert 2111 is located a small ridge 2112, shown in FIG. 4. Along the outspread direction of tab groove 121 is provided with a small tab groove 122, shown in FIG. 5. Tab 2112 is matched with the small tab groove 122 to prevent plug 2 from being misaligned causing polarity errors of the input power.

For example, the periphery of handle 22 is provided with an annular concave-convex garnish gripping region 2217, as shown in FIG. 4.

To connect plug 2 to socket 1, place plug insert 2111 and small ridge 2112 of plug 2 into the plug insert receptacles 121 and small tab grooves 122 of socket 1 in a correct alignment. The wedge-shaped structure of the end of catching structure 242 engages in locking slot 241 located on the periphery of the head of the socket 1. Cables 3 in the plug insert units 2111 and the cables 3 in the plug insert receptacles 121 are butted joint.

To disconnect plug 2 from socket 1, press the push button 243, resulting in the end of the overhead catching structure 242 disengaging from locking slot 241. Then pull plug 2 from socket 1. The design of the handle 22 of plug 2 with the inverted tooth structure works to fix cables 3 so that the effects of pulling on cables 3 will felt only by the inverted teeth, preventing conductive inserts 4 from being disengaged or lost from plug 2.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A connector for a power input, the connector comprising:

a socket including a socket head provided with a plurality of plug insert receptacles, each plug insert receptacle in the plurality of plug insert receptacles receiving a conductive insert, the conductive insert connecting with a cable that extends from the plug insert receptacle through and out of the socket;

a plug including:

a base, a head of the base being provided with a plurality of plug insert units, each plug insert unit in the plurality of plug insert units receiving a conductive insert that connects with a cable that extends out the base of the plug, a first catching structure, a first push button structurally connected to the first catching structure so that pushing the first push button moves the first catching structure from a locking position to an unlocking position, a second catching structure, and a second push button structurally connected to the second catching structure so that pushing the second push button moves the second catching structure from a locking position to an unlocking position; and, a handle for the plug that covers the base of the plug, the handle including:

an upper casing including a recessed section, the first push button located within the recessed section and the recessed section allowing direct user access to the first push button, and a lower casing including a recessed section, the second push button located within the recessed section of the lower casing and the recessed section of the lower casing allowing direct user access to the first push button.

2. A connector as in claim 1, wherein the socket head includes:

a lip that limits insertion of the plug into the socket; and, elastic tab fasteners arranged to secure the socket within the socket opening of the power input;

wherein the tail of the socket and the base are each provided with conduits for guiding cables.

3. A connector as in claim 1:

wherein at least one plug insert receptacle in the plurality of the plug insert receptacles includes a tab groove; and, wherein, at least one plug insert unit in the first plurality of the plug insert units includes a tab, the tab fitting within the tab groove.

4. A connector as in claim 1:

wherein the upper casing includes a first tab located at one side of the upper casing, wherein another side of the upper casing includes a first tab groove, wherein a tail of the upper casing has a cylindrical shape and wherein the upper casing is provided with a threaded hole along one diagonal and a through hole along another diagonal; and, wherein the lower casing has identical structure to the upper casing.

5. A connector as in claim 4:

wherein a second tab extends along a radial direction on one side of the upper casing; and, wherein a second tab groove extends along the radial direction on another side of the upper casing.

6. A connector as in claim 1:

wherein the recessed section of the upper casing is U-shaped; and wherein the recessed section of the lower casing is U-shaped.

7. A connector as in claim 1, wherein the socket includes:

a first locking slot located on the head of the socket that matches the first catching structure so that when the plug is inserted into the socket and the first catching structure is in the locking position, the plug is locked in the socket; and, a second locking slot located on the head of the socket that matches the second catching structure so that when the plug is inserted into the socket and the second catching structure is in the locking position, the plug is locked in the socket.

8. A connector as claim 1, wherein:

an annular concave-convex garnish gripping region is located at a periphery of the handle.

9. A connector for a power input, the connector comprising:

a plug including:

a base, a head of the base being provided with a plurality of plug insert units, each plug insert unit in the plurality of plug insert units receiving a conductive insert that connects with a cable that extends out the base of the plug, a first catching structure, a first push button structurally connected to the first catching structure so that pushing the first push button moves the first catching structure from a locking position to an unlocking position, a second catching structure, and a second push button structurally connected to the second catching structure so that pushing the second push button moves the second catching structure from a locking position to an unlocking position; and, a handle for the plug that covers the base of the plug, the handle including:

an upper casing including a recessed section, the first push button located within the recessed section and the recessed section allowing direct user access to the first push button, and a lower casing including a recessed section, the second push button located within the recessed section of the lower casing and the recessed section of the lower casing allowing direct user access to the first push button; and, a socket, including:

a socket head provided with a plurality of plug insert receptacles, each plug insert receptacle in the plurality of plug insert receptacles receiving a conductive insert, the conductive insert connecting with a cable that extends from the plug insert receptacle through and out of the socket, a first locking slot located on the head of the socket that matches the first catching structure so that when the plug is inserted into the socket and the first catching structure is in the locking position, the plug is locked in the socket, and a second locking slot located on the head of the socket that matches the second catching structure so that when the plug is inserted into the socket and the second catching structure is in the locking position, the plug is locked in the socket.

10. A connector as in claim 9, wherein the socket head includes:

a lip that limits insertion of the plug into the socket; and, elastic tab fasteners arranged to secure the socket within the socket opening of the power input;

wherein the tail of the socket and the base are each provided with conduits for guiding cables.

11. A connector as in claim 9:

wherein at least one plug insert receptacle in the plurality of the plug insert receptacles includes a tab groove; and, wherein, at least one plug insert unit in the first plurality of the plug insert units includes a tab, the tab fitting within the tab groove.

12. A connector as in claim 9:

wherein the upper casing includes a first tab located at one side of the upper casing, wherein another side of the upper casing includes a first tab groove, wherein a tail of the upper casing has a cylindrical shape and wherein the upper casing is provided with a threaded hole along one diagonal and a through hole along another diagonal; and, wherein the lower casing has identical structure to the upper casing.

13. A connector as in claim 12:

wherein a second tab extends along a radial direction on one side of the upper casing; and, wherein a second tab groove extends along the radial direction on another side of the upper casing.

14. A connector as in claim 9:

wherein the recessed section of the upper casing is U-shaped; and wherein the recessed section of the lower casing is U-shaped.

15. A connector as claim 9, wherein:

an annular concave-convex garnish gripping region is located at a periphery of the handle.

* * * * *